US007347579B2

(12) United States Patent
Kohama et al.

(10) Patent No.: US 7,347,579 B2
(45) Date of Patent: Mar. 25, 2008

(54) BUCKLE APPARATUS AND SEAT BELT APPARATUS

(75) Inventors: Shigeru Kohama, Tokyo (JP); Yoshihiro Kawamura, Tokyo (JP); Akira Hirota, Tokyo (JP)

(73) Assignee: Takata Corporation (JP)

( * ) Notice: Subject to any disclaimer, the term of this patent is extended or adjusted under 35 U.S.C. 154(b) by 0 days.

(21) Appl. No.: 11/421,828

(22) Filed: Jun. 2, 2006

(65) Prior Publication Data

US 2006/0285344 A1 Dec. 21, 2006

(30) Foreign Application Priority Data

Jun. 15, 2005 (JP) ..... 2005-174521

(51) Int. Cl.
*B60R 22/48* (2006.01)
*F21V 21/108* (2006.01)

(52) U.S. Cl. ..... 362/108; 362/103; 362/483

(58) Field of Classification Search ..... 362/108, 362/32; 359/543; 340/457.1
See application file for complete search history.

(56) References Cited

U.S. PATENT DOCUMENTS 2,263,953 A * 11/1941 Morcom ..... 359/543
4,928,366 A 5/1990 Ballet
4,933,818 A 6/1990 Eckmann
5,176,439 A * 1/1993 Kawamura ..... 362/108
5,181,773 A 1/1993 Colvin
5,438,492 A 8/1995 Collins et al.
5,618,059 A 4/1997 Kim
5,892,436 A * 4/1999 Blackburn et al. ..... 340/457.1
6,558,027 B2 5/2003 Ellis et al.

FOREIGN PATENT DOCUMENTS

| | | |
|---|---|---|
| JP | 2-140590 | 11/1990 |
| JP | 5-15813 | 3/1993 |
| JP | 10-049084 | 2/1998 |
| JP | 11-085074 | 3/1999 |
| JP | 3065309 | 10/1999 |
| WO | 02/05675 A1 | 1/2002 |
| WO | 2004/002256 A1 | 1/2004 |

* cited by examiner

*Primary Examiner*—Anabel Ton
(74) *Attorney, Agent, or Firm*—Fitch, Even, Tabin & Flannery

(57) ABSTRACT

A buckle apparatus and a seat belt apparatus are provided that are capable of improving the attachment strength of the reflector. In one form, the buckle apparatus includes an upper cover having an insertion inlet at one side, a buckle portion provided in the upper cover and engaged with a tongue of a seat belt inserted through the insertion inlet, a light source provided in the vicinity of the insertion inlet in the upper cover, a reflector for diffusing and leading illuminating light flux eradiated from the light source, which is provided in inner wall faces, that form the insertion inlet by using the reflector as a mold piece.

4 Claims, 10 Drawing Sheets

NON-LATCHED STATE

LATCHED STATE

BUCKLE APPARATUS AND SEAT BELT APPARATUS

FIELD OF THE INVENTION

The present invention relates to a buckle apparatus, and more particularly to a buckle apparatus provided with an illuminating function, and to a seat belt apparatus having the buckle apparatus.

BACKGROUND OF THE INVENTION

Hitherto, in a seat belt apparatus for use in a motor vehicle, or the like, a buckle apparatus for fixing an end portion of webbing (belt) that keeps an occupant under restraint, or the buckle apparatus for fixing a tongue being provided at a turned back end portion of the webbing to a motor vehicle is provided.

FIGS. 9(*a*), 9(*b*), and 10 illustrate an example of such a buckle apparatus in a conventional technology, in which FIG. 9(*a*) is a longitudinal cross-section illustrating a buckle apparatus where a tongue is in a non-latched (disengaged) state with the buckle apparatus, FIG. 9(*b*) is a longitudinal cross-section illustrating the buckle apparatus where the tongue is in a latched (engaged) state with the buckle apparatus, and FIG. 10 is an exploded perspective view illustrating an entire structure of the buckle apparatus. In addition, part of constituting elements shown in FIG. 10 is omitted in FIGS. 9(*a*) and 9(*b*) to avoid complication of the drawings.

(1) Entire Construction of the Buckle Apparatus

In FIGS. 9(*a*), 9(*b*), and 10, elements constituting a buckle apparatus 1 are as follows: a base 2 formed of a U-shaped frame having two of a left and a right side walls, 2*a* and 2*b*, and a bottom portion 2*c*, a latch member 4 being rotatably supported by means of both of the side walls, 2*a* and 2*b*, of the base 2, and capable of being latched (hooked) with a tongue 3 that serves as a member for a belt, which is to be latched, a slider (locking member) 5 that is movably supported by means of the latch member 4 for relative movement on an upper face of the latch member 4, and that prevents the latch member 4 from moving in a releasing direction for a latched state of the latch member 4 when the tongue 3 and the latch member 4 are latched with each other, a slider spring 6 that always causes the slider 5 to be biased toward the latch member 4 by means of being compressed between the slider 5 and the latch member 4, a locking pin 7 being rotatably supported by means of holes, 2*d* and 2*e*, of both of the side walls, 2*a* and 2*b*, of the base 2, which presses (locks) an upper face of the slider 5 that prevents the latch member 4 from moving in the releasing direction for the latched state of the latch member 4 when the tongue 3 and the latch member 4 are latched with each other, a release button (operation member) 8 movably provided in a longitudinal direction at both of the side walls, 2*a* and 2*b*, of the base 2, an inertia lever 9 positioned between a release button 8 and the latch member 4 and being rotatably supported by means of grooves, 2*f* and 2*g*, of both of the side walls, 2*a* and 2*b*, an ejector 10 being slidably provided in a longitudinal direction of the base 2 at a bottom portion 2*c* of the base 2 and separating the tongue 3 from the buckle apparatus 1, an ejector spring 11 that always keeps the ejector 10 being biased in a direction for the tongue 3 to be separated from the buckle apparatus 1, and covers (an upper cover UC and a lower cover LC) that include these elements described above in a manner so as to cover from above and below.

The latch member 4 is provided with rotating shafts, 4*a* and 4*b*, and the rotating shafts, 4*a* and 4*b*, are rotatably supported by means of supporting grooves, 2*h* and 2*i*, formed in both of the side walls, 2*a* and 2*b*, of the base 2. In this case, the latch member 4 is biased in a clockwise direction in the drawings by means of the slider spring 6, in the disengaged (non-latched) state shown in FIG. 9(*a*), and the latch member 4 is biased also in the clockwise direction in the drawings by means of the ejector spring 11 in the latched state, shown in FIG. 9(*b*). As a result, the latch member 4 is always biased by means of either one of two springs, 6 and 11. Further, the latch member 4 is provided with a pair of arms, 4*d* and 4*e*, which is extended from the rotation shafts, 4*a* and 4*b*, each of tip end portions of which serves as portions, 4*d*1 and 4*e*1, to be pressed. Both of these portions, 4*d*1 and 4*e*1, to be pressed are respectively constructed to be capable of being pressed rightward in FIG. 9(*a*) by means of pressing portions, 10*a* and 10*b*, (shown in FIG. 10), of the ejector 10 at a right end thereof, as described later.

The slider 5 is provided with a protruding shaft 5*a* at a center thereof extending in a longitudinal direction of the buckle apparatus 1 and the protruding shaft 5*a* is penetrating through a hole 4*c* of the latch member 4. In addition, the protruding shaft 5*a* is fit into the slider spring 6 and the slider spring 6 is compressed by being sandwiched between the latch member 4 and the slider 5. Further, the slider 5 is provided with a pair of left and right hooking shafts, 5*b* and 5*c*.

The pair of hooking shafts, 5*b* and 5*c*, are respectively engaged and supported by means of engaging grooves, 2*j* and 2*k*, respectively formed at both of the side walls, 2*a* and 2*b*, of the base 2, and are protruding outward in a predetermined amount from both of the side walls, 2*a* and 2*b*. In this case, both of the engaging grooves, 2*j* and 2*k*, respectively having first groove portions, 2*j*1 and 2*k*1, both of which are extending in a longitudinal direction (namely, the moving direction of the release button 8) of the buckle 1, and second groove portions, 2*j*2 and 2*k*2, extending upward in a sloping manner from these first groove portions, 2*j*1 and 2*k*1, in an opening manner. Further, the hooking shafts, 5*b* and 5*c* of the slider 5 are respectively configured to be movable along the first groove portions, 2*j*1 and 2*k*1, in usual operation, and are configured to be movable along the first groove portions, 2*j*1 and 2*k*1, and the second groove portions, 2*j*2 and 2*k*2, in an unusual operation, i.e., when the latched state is forcibly released.

On the other hand, the side walls, 2*a* and 2*b*, of the buckle apparatus 1 including each of the grooves and the holes have line symmetry at a center line in a longitudinal direction of the buckle apparatus 1.

The release button 8 is provided with a left and a right side walls, 8*a* and 8*b*, extending in a longitudinal direction of the buckle apparatus 1, and a left and a right protruding portions, 8*c* and 8*c* (although only one protruding portion is shown and the other protruding portion is not shown, both of the protruding portions are denoted by 8*c*, as a matter of convenience for later explanation), extending in a longitudinal direction of the buckle apparatus 1 are respectively provided between the side walls, 8*a* and 8*b*, as shown in FIG. 10. A pressing portion 8*f* that is having a vertical face (in a similar manner, both of the pressing portions are hereinafter referred to as 8*f*), which presses each of the engaging shafts, 5*b* and 5*c*, of the slider 5 so as to move the same in a releasing direction when the releasing button 8 is moved in a releasing direction, is formed in each of the internal faces of both of the side walls, 8*a* and 8*b*.

On the other hand, similar to the side walls, 2*a* and 2*b*, of the buckle apparatus 1, both of the side walls, 8*a* and 8*b*, of the release button 8 have line symmetry at the center line in a longitudinal direction of the buckle apparatus 1.

The inertia lever 9 is provided with a pair of left and right rotation shafts, 9*a* and 9*b*, and these rotation shafts, 9*a* and 9*b*, are rotatably fit into the grooves, 2*f* and 2*g*, of both of the side walls, 2*a* and 2*b*, of the base 2. Further, the inertia lever 9 is provided with a engaging connecting portion 9*c* at a lever side formed of a round pin-like shape having a round cross-section.

(2) Basic Motion of the Buckle Apparatus

Next, a latching motion of the buckle apparatus 1 with the tongue 3 in the thus constructed present embodiment will be explained.

In the non-latched state of the buckle apparatus 1 where the tongue 3 is not inserted thereto, a position of the ejector 10 is set to the position of a leftmost limit by means of spring force of the ejector spring 11, as shown in FIG. 9(*a*). In the leftmost limit position of the ejector 10, the latch member 4 is rotated in an upper direction (in a clockwise direction from the latched state) in relationship among the slider 5, the locking pin 7, and the slider spring 6. At this moment, the slider 5 is disengaged from the locking pin 7 and is positioned to be upwardly rotated. As a result, an upper face of the latch member 4 is kept in contact with a lower face of the locking pin 7. In this state, a joggle portion 4*f* of the latch member 4 is moved away from the inserting path of the tongue 3 and the latch member 4 is set to be at a non-latching position where the joggle portion 4*f* is not latched with the tongue 3.

When the tongue 3 is inserted through an opening (tongue insertion inlet) 1*a* that is provided at one side end portion (left end portion in the middle in FIGS. 9(*a*) and 9(*b*)) of the upper cover UC of the buckle apparatus 1, in the non-latched state of the buckle apparatus 1, shown in FIG. 9(*a*), a right end of the tongue 3 is caused to be in contact with a left end of the ejector 10 and the ejector 10 is pressed rightward. Then, because the ejector 10 moves rightward compressing the ejector spring 11 corresponding to an inserting amount of the tongue 3, a pressing portions 10*a* and 10*b* of the ejector 10 presses the portions, 4*d*1 and 4*e*1, of the latch member 4 to be pressed, in a rightward direction and thereby the latch member 4 is downwardly (in a counterclockwise direction) rotated. Consequently, the joggle portion 4*f* of the latch member 4 proceeds to a moving path of the tongue 3 and is fit into a latching hole 3*a* of the tongue 3. Accordingly, the latch member 4 is in a latching position. Further, when inserting force of the tongue 3 is released, the ejector 10 presses the right end of the tongue 3 by means of spring force of the ejector spring 11; a right end portion of the latching hole 3*a* of the tongue 3 is engaged with the joggle portion 4*f*; the tongue 3 is latched with the buckle apparatus 1; and the tongue 3 and the buckle apparatus 1 are caused to be in a latched state, shown in FIG. 9(*b*).

At this moment, the slider 5 proceeds to a position below the locking pin 7 by means of the spring force of the slider spring 6, and an upper face of the slider 5 is pressed by the locking pin 7. Accordingly, the latch member 4 cannot be pulled out from the latching hole 3*a* of the tongue 3 and the latched state of the tongue 3 and the buckle apparatus 1 are firmly maintained. This is because the slider 5 holds the latch member 4 at a latching position, shown in FIG. 9(*b*).

When the release button 8 is pressed rightward so as to release the latched state of the tongue 3 and the buckle apparatus 1, shown in FIG. 9(*b*), the release button 8 is moved rightward. Further, a pressing portion 8*f* of the release button 8 presses each of the engaging shafts, 5*b* and 5*c*, of the slider 5 rightward, and the slider 5 is moved rightward, i.e., in a direction toward the latch member 4, against the biasing force of the slider spring 6. Then, the engaging shafts, 5*b* and 5*c*, of the slider 5 are displaced from the first groove portions, 2*j*1 and 2*k*1, and a left end upper face of the slider 5 is displaced from a lower face of the locking pin 7. As a result, the slider 5 is caused not to be pressed by means of the locking pin 7.

Then, the slider 5 and the latch member 4 are rotated in a clockwise direction and the joggle portion 4*f* is moved upward. The ejector 10 strikes up the latch member 4 via the tongue 3; the latch member 4 and the slider 5 are further rotated in a clockwise direction around the rotation shafts, 4*a* and 4*b*, as a rotation center; the joggle portion 4*f* is displaced away from the latching hole 3*a* of the tongue 3; and at the same time, the tongue 3 is pushed out in a left direction. This is because the ejector 10 is kept under tension in a direction for releasing the latched state by the spring force of the ejector spring 11.

As shown in FIG. 9(*a*), when an upper face of a joggle portion 4*f* side of the latch member 4 is caused to be in contact with the locking pin 7, the rotation of the latch member 4 and the slider 5 in a clockwise direction is stopped. At this moment, a left end of the slider 5 is caused to be in contact with the locking pin 7 by means of the tension force of the slider spring 6. Finally, the ejector 10 is located at a leftmost limit position, and the latch member 4 is located at a non-latching position. Consequently, the buckle apparatus 1 is in the non-latched state where the tongue 3 is displaced.

In addition, for switching the aforementioned positions of the buckle apparatus 1 and the tongue 3, from the latched position to the non-latched position, and vice versa, a magnet 50 (a permanent magnet) for detecting the latched state is provided in the slider 5, as shown in FIG. 10. Correspondingly, a magnet sensor 100 for generating electromotive force by means of a magnetic field of the aforementioned magnet 50 is provided in a sensor holder 60 whose claw portions, 60*a* and 60*b*, are latched with a engaging holes, 2*p* and 2*q*, of both of the side walls, 2*a* and 2*b*, of the base 2. The magnet sensor 100 detects whether the slider 5 is contiguous to (corresponding to the non-latched state) or distant from (corresponding to the latched state) the magnet sensor 100 on the basis of that the magnet field is small or large, and outputs corresponding current value, for example.

On the other hand, in such a buckle apparatus 1, particularly, at a nighttime or the like, when an inside of a room of the motor vehicle is in a state of a darkroom, a buckle apparatus provided with an illuminating function to ease recognition for a position of the buckle apparatus 1, or to ease recognition for an inserting opening of the buckle apparatus 1 for inserting the tongue 3, is known (for example, refer to Japanese Unexamined Utility Model Registration Application Publication No. 5-15813).

FIG. 8 is a perspective view illustrating an illumination apparatus that is built in the buckle apparatus of the aforementioned conventional technology.

In an illumination apparatus, shown in FIG. 8, a printed circuit board 20 is disposed at the aforementioned lower cover LC. A plurality of conductive wiring portions 21 are formed in the printed circuit board 20. Further, a harness 22 connected to a controller (not shown), an LED 23 for illuminating the vicinity of an insertion inlet for the tongue 3, and a resistor 24 for setting electric current supplied to the LED to a predetermined value are connected to the wiring portion 21, by means of soldering.

The LED 23 is disposed in the vicinity of the insertion inlet for the tongue 3, and for example, a portion around the insertion inlet for the tongue 3 is illuminated by emitting light when the controller detects that an occupant is seated in a seat.

At this moment, the illuminating light flux eradiated from the LED 23 is fixed by adhering a light guide (a reflector) to a printed circuit board 20 so as to improve visibility for the insertion inlet 1*a*.

On the other hand, the reflector that is thus provided in the vicinity of the insertion inlet 1*a* is required to have attachment strength that can sufficiently endure a shock of contact with a tongue 3 so as not to dropped off, because there is a possibility that a tongue 3 comes into contact with the reflector when an operator (an occupant) inserts the tongue 3 into the insertion inlet 1*a*. However, in the thus constructed conventional buckle apparatus, it has been hard to secure sufficient attachment strength because the buckle apparatus has the construction in which a light guide (reflector) is merely adhered and fixed to the printed circuit board 20.

SUMMARY OF THE INVENTION

Accordingly, it is an object of the present invention to provide a buckle apparatus and a seat belt apparatus capable of improving the attachment strength of the reflector.

To achieve the above-described object, a buckle apparatus in one form is characterized in including a cover having an insertion inlet at one side, a buckle portion provided in the cover and engaged with a tongue of a seat belt inserted through the insertion inlet, a light source provided in the vicinity of the insertion inlet in the cover, and a reflector provided in the cover by means of integral molding process and for leading illuminating light flux eradiated from the light source.

The buckle apparatus in a second form is characterized in that a part of the reflector is buried in an inner wall face of the cover that forms the insertion inlet.

The buckle apparatus in a third form is characterized in that a leg portion is buried in two wall faces that construct a corner portion of the inner wall face of the cover forming the insertion inlet.

A seat belt apparatus in a fourth form is characterized in including webbing for keeping an occupant under restraint, a retractor apparatus capable of retracting the webbing, a buckle apparatus connected to a fixing-side member, and a tongue provided in the webbing, in which the buckle apparatus includes a cover having an insertion inlet at one side, a buckle portion provided in the cover and engaged with the tongue being inserted through the insertion inlet, a light source provided in the vicinity of the insertion inlet in the cover, and a reflector provided by means of integral molding process and for leading illuminating light flux eradiated from the light source.

According to a buckle apparatus of the first form and a seat belt apparatus of the fourth form, a reflector is provided in a cover for the buckle apparatus by means of integral molding process and thereby attachment strength of the reflector to the cover is improved and the reflector is prevented from being dropped off. Further, because the reflector is being formed by means of integral molding process, it also functions as a strength reinforcing member for the cover, strength of the cover is improved.

According to the buckle apparatus of the second form, a part of the reflector is buried in an inner wall face of the cover that forms the insertion inlet and thereby integration of the reflector and the cover side is firmly realized and attachment strength is securely improved.

According to the buckle apparatus of the third form, a leg portion of the reflector is buried in two wall faces that construct a corner portion of the inner wall face of the cover forming the insertion inlet and thereby integration of the reflector and two wall faces of the cover is firmly realized and the attachment strength can be securely improved.

BRIEF DESCRIPTION OF THE DRAWINGS

FIG. 2(*b*) is a horizontal cross-section illustrating the main part of the buckle apparatus;

FIG. 2(*c*) is a longitudinal cross-section illustrating the main part of the buckle apparatus looking from the front direction;

FIG. 2(*d*) is a longitudinal cross-section illustrating the main part of the buckle apparatus, looking from the side-face direction;

FIG. 3(*b*) is a perspective view illustrating an appearance of the reflector;

FIG. 4(*b*) is a side elevation showing a relationship between the reflector and a slimline LED light source of the buckle apparatus with respect to the present invention;

FIG. 5(*b*) is a side view showing a relationship between the reflector and an LED light source of the buckle apparatus with respect to the present invention;

FIG. 6(*b*) is a side view showing a relationship between the reflector and an LED light source of the buckle apparatus with respect to the present invention;

FIG. 9(*b*) is a longitudinal cross-section illustrating a conventional buckle apparatus in a latched (engaged) state with the tongue.

DETAILED DESCRIPTION OF THE PREFERRED EMBODIMENTS

A buckle apparatus and a seat belt apparatus of the present invention will be explained on the basis of FIGS. 1 through 7.

Figure 1:
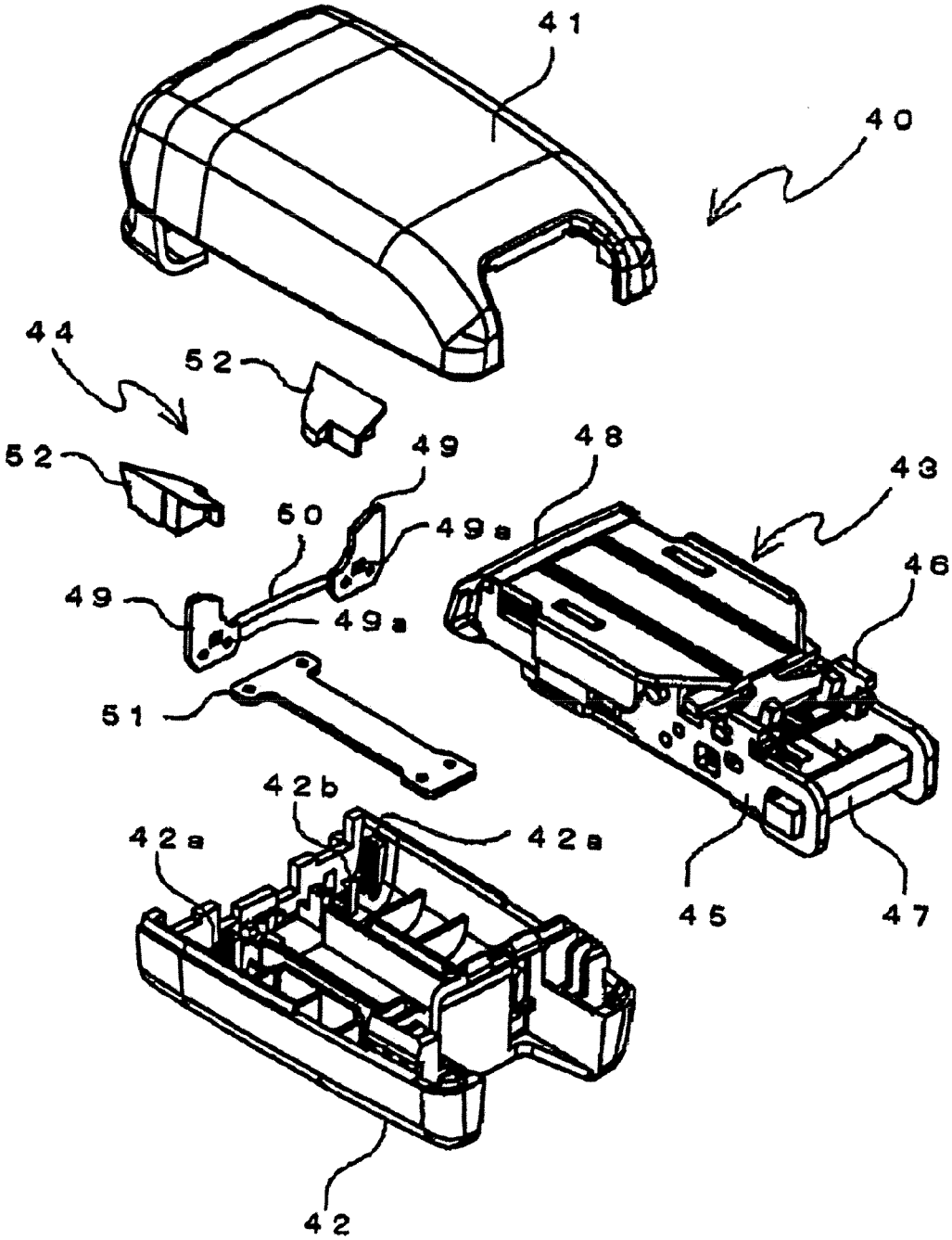
FIG. 1 is an exploded perspective view illustrating a buckle apparatus with respect to the present invention.
Figure 2A:
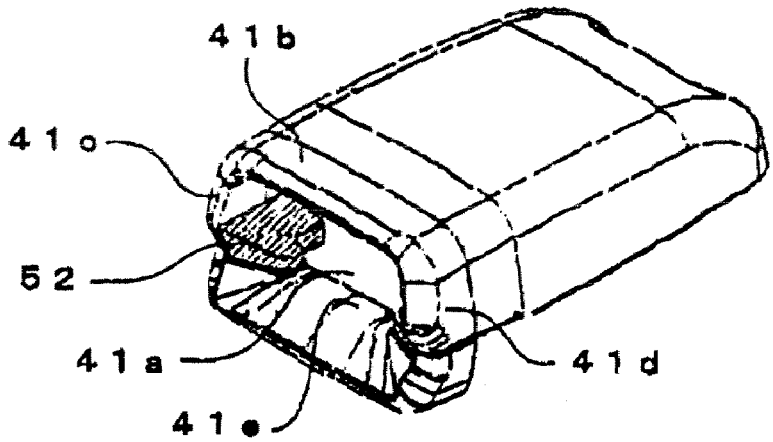
FIG. 2(*a*) is a perspective view illustrating a main part of the buckle apparatus with respect to the present invention.
Figure 2B:
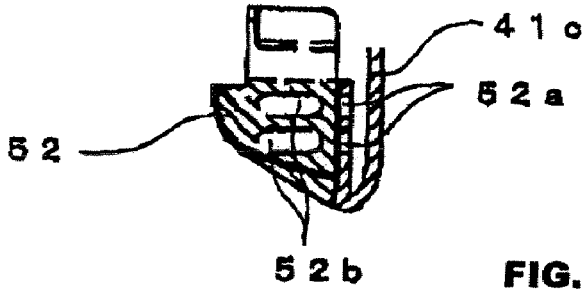
Figure 2C:
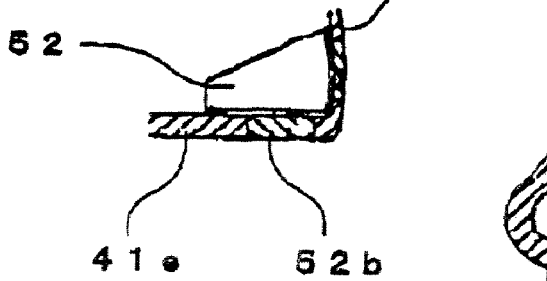
Figure 2D:
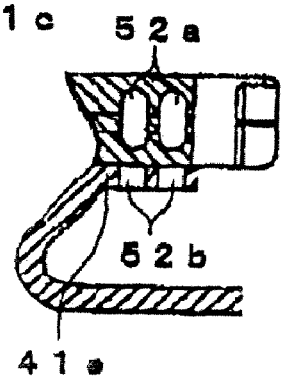

FIG. 1 is an exploded perspective view illustrating a buckle apparatus with respect to the present invention; FIG.

Figure 3A:
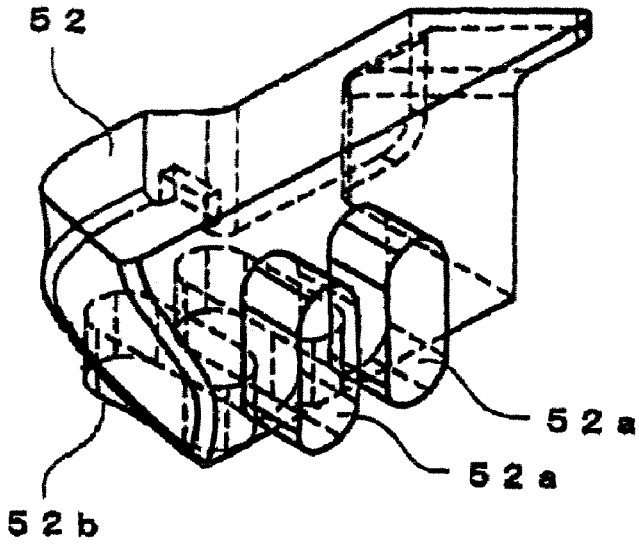
FIG. 3(*a*) is a perspective view of a reflector.
Figure 3B:
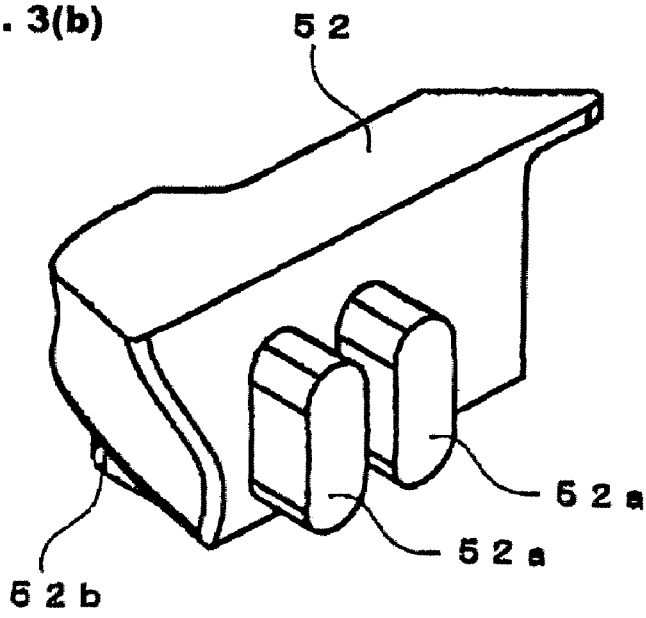
Figure 4A:
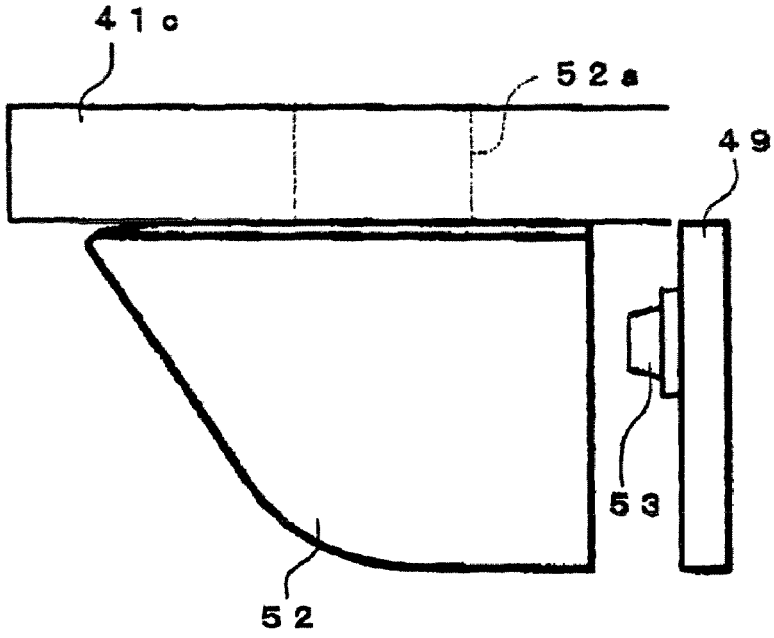
FIG. 4(*a*) is a plan view showing a relationship between the reflector and a slimline LED light source of the buckle apparatus with respect to the present invention.
Figure 4B:
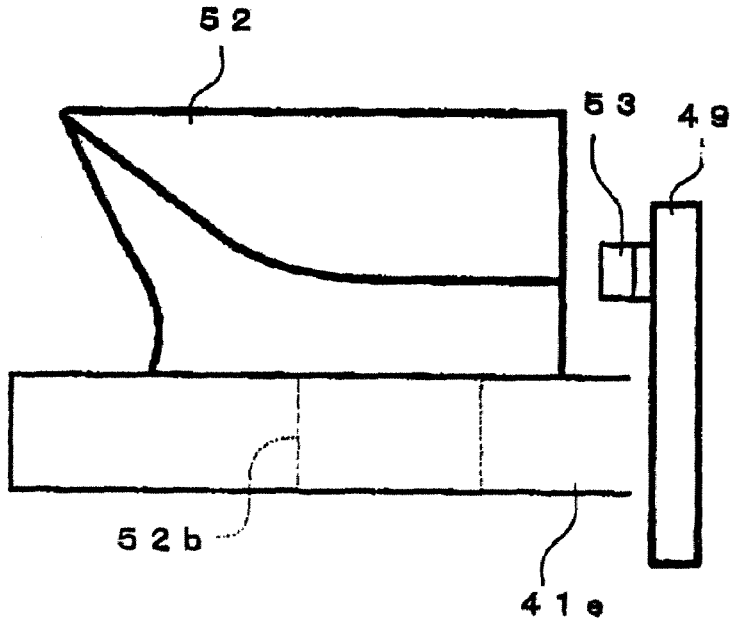
Figure 5A:
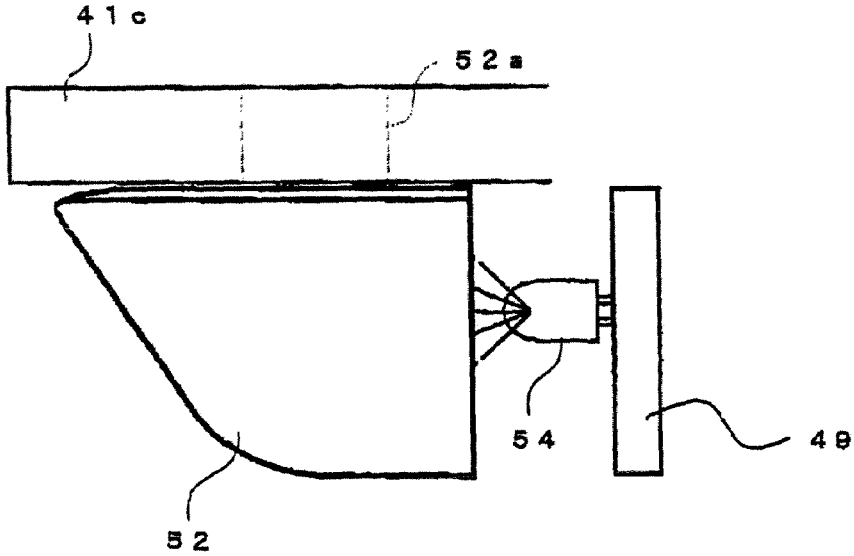
FIG. 5(*a*) is a plan view showing a relationship between the reflector and an LED light source of the buckle apparatus with respect to the present invention.
Figure 5B:
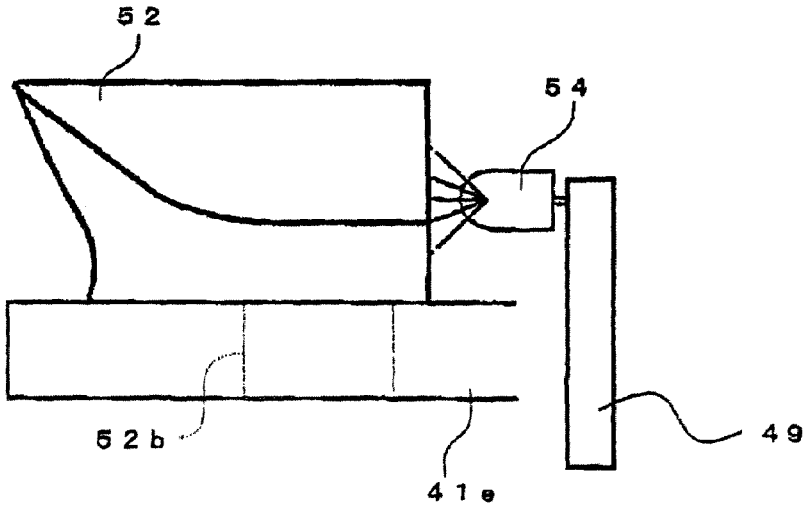
Figure 6A:
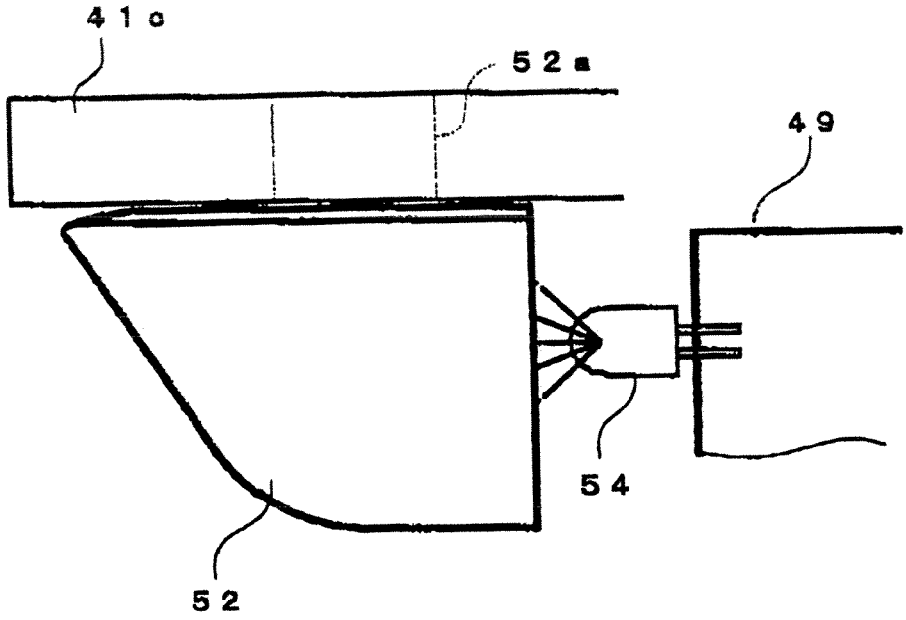
FIG. 6(*a*) is a plan view showing a relationship between the reflector and an LED light source of the buckle apparatus with respect to the present invention.
Figure 6B:
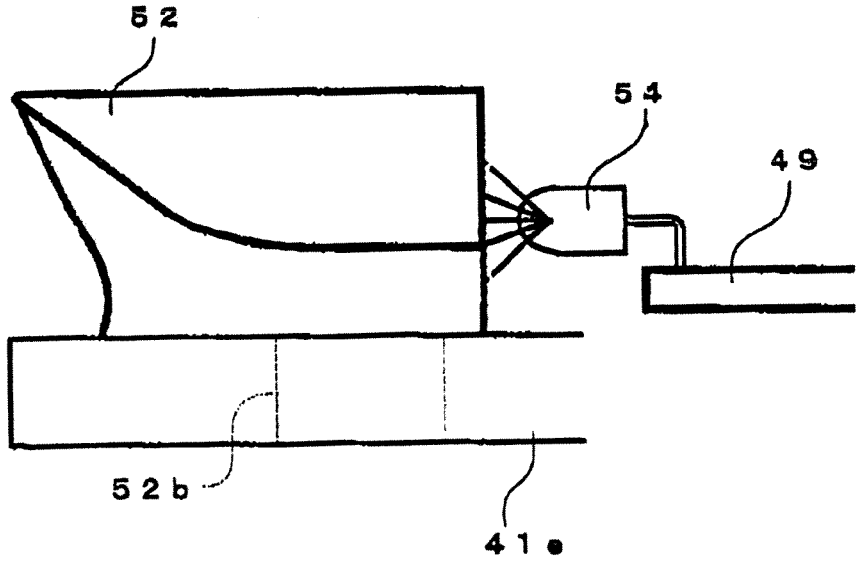

2(*a*) is a perspective view illustrating a main part of the buckle apparatus with respect to the present invention, FIG. 2(*b*) is a horizontal cross-section illustrating the main part of the buckle apparatus with respect to the present invention; FIG. 2(*c*) is a longitudinal cross-section illustrating the main part of the buckle apparatus looking from the front, and FIG. 2(*d*) is a longitudinal cross-section illustrating the main part of the buckle apparatus looking from the side-face direction; FIG. 3(*a*) is a perspective view illustrating a reflector; FIG. 3(*b*) is a perspective view illustrating an appearance of the reflector; FIG. 4(*a*) is a plan view showing a relationship between the reflector and a slimline LED light source of the buckle apparatus with respect to the present invention; FIG. 4(*b*) is a side view showing a relationship between the reflector and a slimline LED light source of the buckle apparatus with respect to the present invention; FIG. 5(*a*) is a plan view showing a relationship between the reflector and an LED light source of the buckle apparatus with respect to the present invention; FIG. 5(*b*) is a side view showing a relationship between the reflector and an LED light source of the buckle apparatus with respect to the present invention; FIG. 6(*a*) is a plan view showing a relationship between the reflector and an LED light source of the buckle apparatus with respect to the present invention, and FIG. 6(*b*) is a side view showing a relationship between the reflector and an LED light source of the buckle apparatus with respect to the present invention; and FIG. 7 is a perspective view illustrating a seat belt apparatus for use in a driver's seat of a motor vehicle in a using state, showing an example of the seat belt apparatus.

Figure 7:
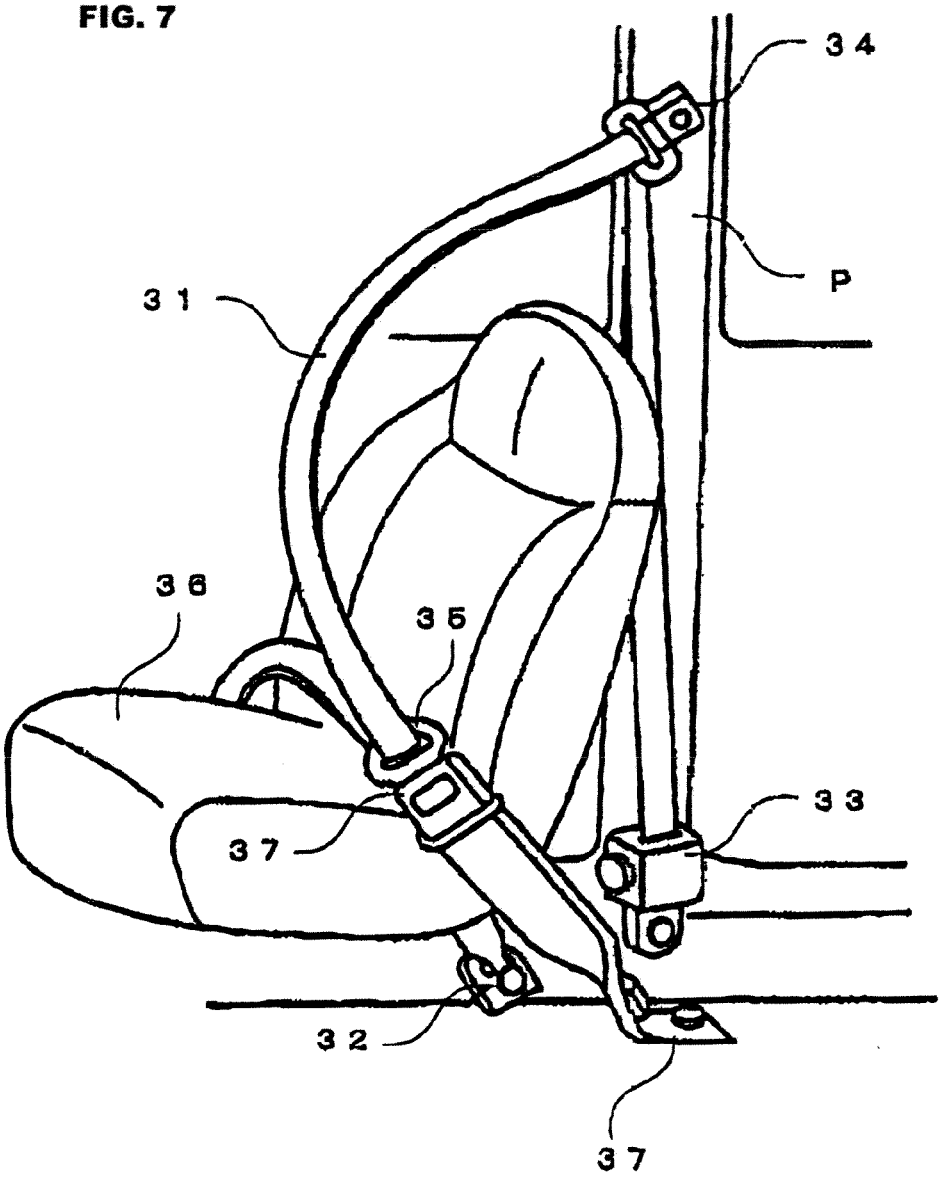
FIG. 7 is a perspective view illustrating a seat belt apparatus for use in a driver's seat of a motor vehicle in a using state, showing an example of the seat belt apparatus.
Figure 8:
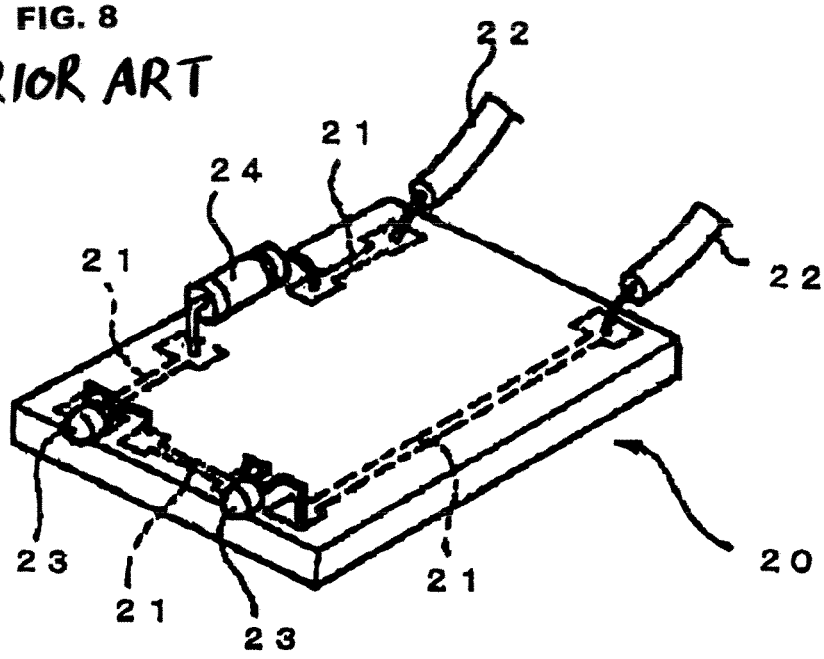
FIG. 8 PRIOR ART
FIG. 8 is a perspective view illustrating an illuminating apparatus that is built in a conventional buckle apparatus.
Figure 9A:
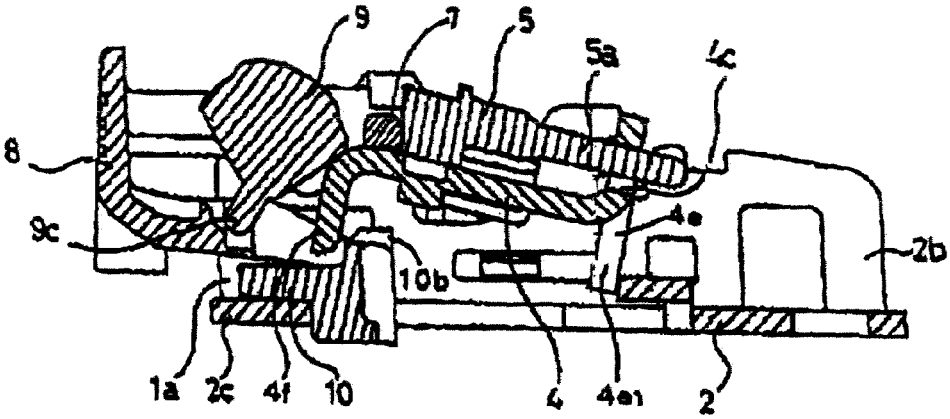
FIG. 9(a) PRIOR ART
FIG. 9(*a*) is a longitudinal cross-section illustrating the conventional buckle apparatus in a non-latched (disengaged) state with a tongue.
Figure 9B:
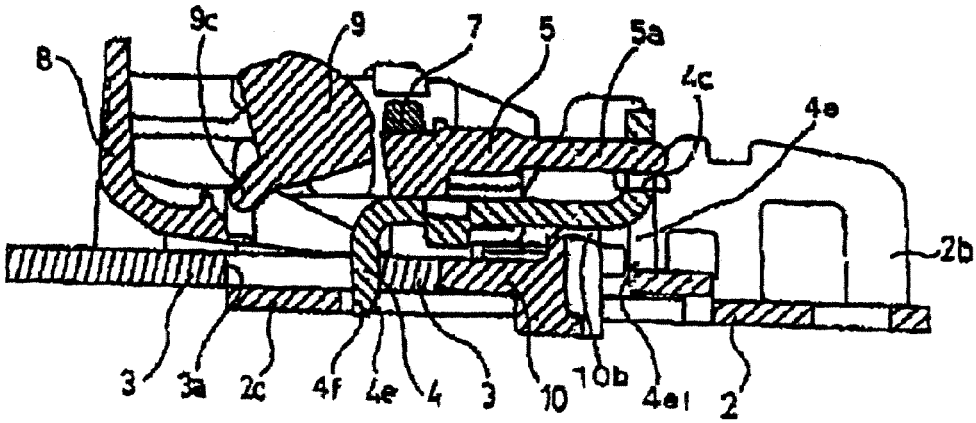
FIG. 9(b) PRIOR ART
Figure 10:
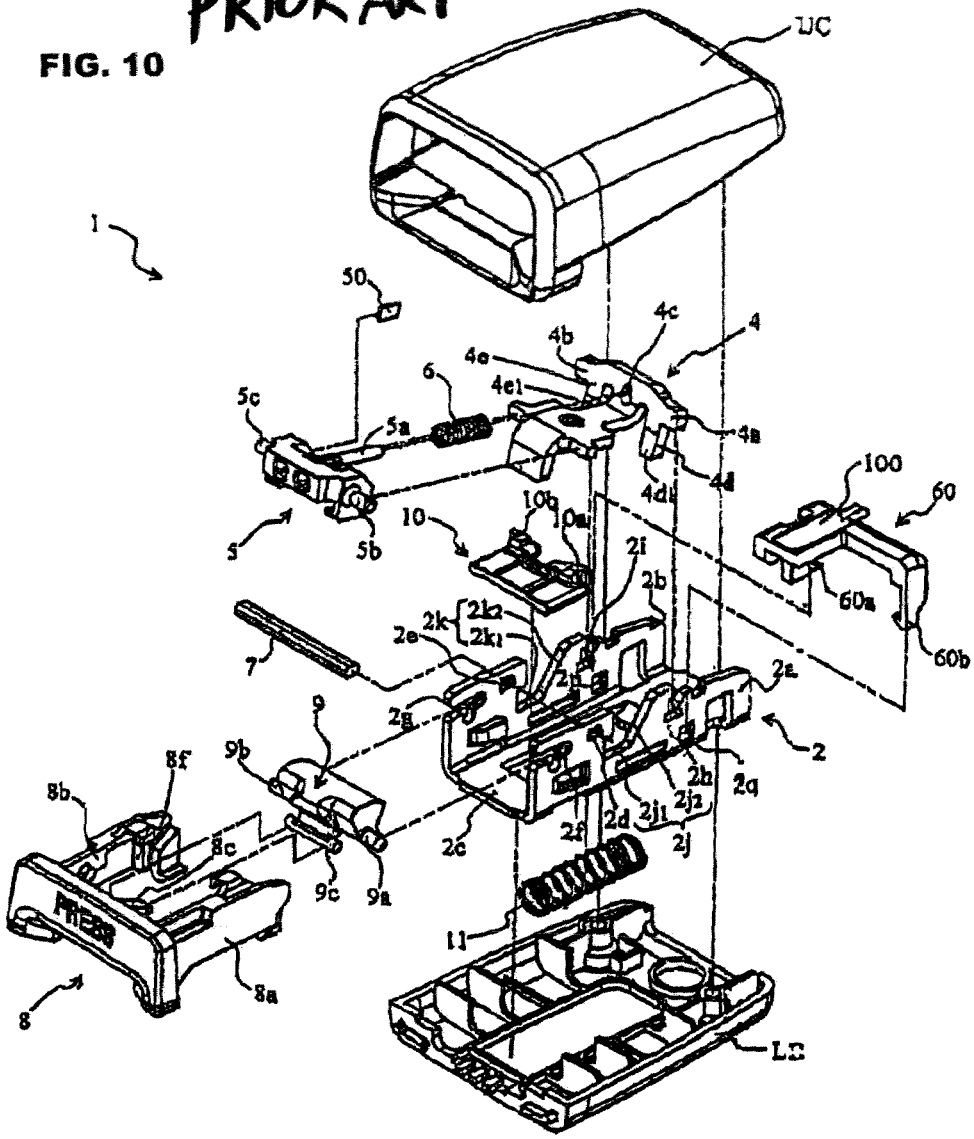
PRIOR ART FIG. 10
FIG. 10 is an exploded perspective view illustrating an entire structure of the conventional buckle apparatus.

In FIG. 7, a numeral 31 denotes webbing for keeping an occupant under restraint, one end of which is supported by means of an anchor 32 fixed in the vicinity of a floor face of the motor vehicle, and the other end of which is retractably supported by means of a retractor apparatus 33 fixed in the vicinity of the floor face of the motor vehicle; a numeral 34 denotes a shoulder anchor, through which a middle portion of the webbing 31 is inserted, which is rotatably held on a center pillar P of the motor vehicle being situated nearer an upper part thereof; and a numeral 35 denotes a tongue being provided between the anchor 32 and the shoulder anchor 34, being positioned at a side opposite to the anchor 32 across a seat 36, and being engageable with a buckle apparatus 40 connected to a predetermined fixation side member 37.

The buckle apparatus 40 is formed into a predetermined housing shape by means of a combination structure of an upper cover 41 and a lower cover 42, both of which constitute a cover of the buckle apparatus 40, as shown in FIG. 1. In addition, a buckle portion 43 to be engaged with the tongue 35, when the tongue 35 is inserted, and an illuminating portion 44 situated nearer an insertion inlet side for the tongue 35 in relation to the buckle portion 43 are provided in an inner part of the buckle apparatus 40.

The upper cover 41 is integrally provided with wall faces, 41*b* through 41*e*, by which four sides of the insertion inlet 41*a* of the tongue 35 are surrounded, as shown in FIG. 2(*a*).

The buckle 43 is provided with a base 45 that is functionally and substantially identical of the base 2 formed of the U-shaped frame that is explained in Background Art section, and a latch member 46 being rotatably supported at both sides of the base 45 and capable of being latched with the tongue 35. However, a detailed explanation therefor will be omitted here. Further, a shaft 47 to be connected to the fixation side member 37 and an operating member 48 to be used when a releasing operation for locking is performed are provided in the base 45.

The illuminating portion 44 is provided with a pair of LED holding boards 49 which is installed in a standing manner in a vertical (up and down) direction, shown in FIG. 1, a flexible lead wire 50 that electrically connects the pair of LED holding boards 49, a switch board 51 that electrically connects the lead wire 50 and a power source at a motor vehicle side (not shown), a reflector (lens) 52 being fixed to a tip end of the switch board 51, which is situated nearer the tongue insertion inlet side in relation to an LED holding board 49. In addition, although the switch board 51 and the LED holding board 49 are electrically connected by means of a lead wire (not shown) or the like, the switch board 51 may be integrally formed with the LED holding board 49.

In the reflector 52, the leg portions, 52*a* and 52*a*, are formed in a protruding manner at a side-face side and a bottom-face side thereof, as shown in FIGS. 3(*a*) and 3(*b*).

The LED holding board 49 is inserted into a pair of guide groove walls, 42*a* and 42*a*, formed in the lower cover 42, and the hooking claw 42*b* is hooked with the hooking hole 49*a*. Thereby the LED holding board 49 is held by means of the lower cover 42 by mere inserting operation.

Further, a slimline LED light source 53 facing the reflector 52 is provided in the LED holding board 49, as shown in FIGS. 4(*a*) and 4(*b*). Further, in replacement of the slimline LED light source 53, a usual dome-type LED light source 54 may be applicable, as shown in FIGS. 5(*a*) and 5(*b*), or the dome-type LED light source 54 may be attached to a transverse LED holding board 49, as shown in FIGS. 6(*a*) and 6(*b*).

The thus described reflector 52 is set in a predetermined resin metallic mold such that the leg portions, 52*a* and 52*b*, are positioned at four sides of lower side corner portions that construct an inserting inlet 41*a* of the upper cover 41, and are buried by means of each of the wall faces 41*e*, 41*c*, and the wall faces 41*e*, 41*d*. In this state, the upper cover 41 is molded by resin and thereby the insertion inlet 41*a* is molded and the reflector 52 is fixed thereto at the same time. According to the above-described structure of the upper cover 41 and the reflector 52, attachment strength of the reflector 52 to the upper cover 41 can be improved and therefore, even though the tongue 35 comes into contact with the insertion inlet 41*a* when the operator (occupant) inserts the tongue 35 into the insertion inlet 41*a*, the insertion inlet 41*a* can sufficiently endure a shock of contact with a tongue 3 and the reflector 52 is prevented from being dropped off from the upper cover 41. In addition, when heat occurs is generated in the LED holding board 49 and/or the switch board 51, it is advantageous that the reflector 52 is hard to receive an effect of the heat. Further, because the reflector 52 is being integrally formed in the upper cover 41, it also functions as a strength reinforcing member of the upper cover 41, the strength of the entire cover can also be improved.

What is claimed is:

1. A buckle apparatus comprising:

a molded cover for the buckle mechanism;

an inlet of the cover through which a seat belt tongue is inserted for being releasably latched by the latch member;

a light source operable to illuminate the inlet;

a reflector positioned and configured to receive light from the light source and direct the light toward the inlet; and a predetermined portion of the reflector embedded at the molded cover, wherein the cover forms a pair of corner portions on either side of the inlet, and the reflector and predetermined portion thereof comprise a pair of reflectors and predetermined portions with each one of the pair of reflectors fixed at a respective one of the corner portions with the associated reflector predetermined portion embedded in the corner portion.

2. A method of assembling a light reflector and buckle cover, the method comprising:

placing a reflector in a mold; and molding the buckle cover so that a portion of the reflector is embedded in a portion of the buckle cover to fix the reflector relative to the cover with another exposed portion of the reflector projecting out from the buckle cover portion so that the exposed portion has a surface positioned adjacent an inlet of the buckle cover for illumination thereof.

3. The method of claim 2 wherein the buckle cover is molded by injecting resin into the mold.

4. A method of assembling a light reflector and buckle cover, the method comprising:

placing a reflector in a mold; and molding the buckle cover so that a portion of the reflector is embedded in a portion of the buckle cover to fix the reflector relative to the cover, wherein the buckle cover has walls extending about the insertion inlet for a seat belt tongue, the reflector is placed in the mold by arranging a projection of the reflector at a position where one of the walls is to be formed in the mold, and molding the buckle cover includes molding the walls with the reflector projection embedded in the one wall.

* * * * *